US005283997A

United States Patent [19]

Lackie

[11] Patent Number: 5,283,997

[45] Date of Patent: Feb. 8, 1994

[54] CORNER ELEMENT FOR CABINETS

[76] Inventor: Edward J. Lackie, 250 Flower St., Costa Mesa, Calif. 92627

[21] Appl. No.: 916,021

[22] Filed: Jul. 17, 1992

[51] Int. Cl.[5] ..... E04B 1/00

[52] U.S. Cl. ..... 52/287.1; 52/254

[58] Field of Search ..... 52/287, 254, 255, 288

[56] References Cited

U.S. PATENT DOCUMENTS

| | | | |
|---|---|---|---|
| 799,430 | 9/1905 | Anderson | 52/288 |
| 2,279,755 | 5/1942 | Lemen | 52/288 |
| 2,915,794 | 12/1959 | Hillmann | 52/288 |
| 2,921,352 | 1/1960 | Pfeifle | 52/288 |
| 4,091,586 | 5/1978 | Schwartz | 52/288 |
| 4,283,894 | 8/1981 | Raty | 52/288 |
| 4,893,447 | 1/1990 | Opp | 52/288 |
| 4,998,947 | 3/1991 | Dostall | 52/254 |

OTHER PUBLICATIONS

British Specification, New or Improved Means for Blanking off Interior Angles of Bldgs & Structures, 846303; FIG. 4; Aug. 1960.

British Specification, Improvements relating to the Mounting of Panels and the Like, 568852, FIG. 1, May 1945.

*Primary Examiner*—Carl D. Friedman
*Assistant Examiner*—Beth A. Aubrey
*Attorney, Agent, or Firm*—Roy A. Ekstrand

[57] ABSTRACT

A corner element for use in combination with cabinet corner structures such as those found in kitchen cabinets or the like includes a pair of side portions having an angular relationship therebetween which corresponds to the angle of cabinet intersection. An obliquely angled facet extends between the side portions. A generally cylindrical concave curved surface extends between the remaining end portions of the side surfaces to complete the corner element. In its preferred use, the corner element is secured to the cabinet base portions at the corner area to interpose the curved surface between the base portions and preclude dirt or debris from accumulating within the corner intersection of the cabinet bases.

9 Claims, 2 Drawing Sheets

CORNER ELEMENT FOR CABINETS

FIELD OF THE INVENTION

This invention relates generally to cabinets and similar structures and particularly to the intersecting portions thereof.

BACKGROUND OF THE INVENTION

Perhaps one of the familiar structures in modern dwellings is that generally referred to as cabinets or the like. For example, in a typical kitchen environment, a substantial amount of storage is provided by a plurality of floor supported storage cabinets usually topped by a countertop or work surface. Often a plurality of additional cabinets are supported above the countertop work surface in a configuration generally conforming to the arrangement of floor supported cabinets. While the structures of such cabinets is subject to substantial design variation and aesthetic considerations, generally all utilize a partially recessed support base at the junction between the lower cabinets and the supporting floor. As a general convenience element, this recessed base portion permits the user to stand close to the countertop work surface while engaging in various kitchen tasks and allows the user's feet to be comfortably positioned upon the floor extending beneath the cabinets. It has been found through the years that this recessed base portion greatly enhances the comfort and avoids the difficulty associated with standing close to the cabinets and countertops which would otherwise arise without the use of such recessed portions.

While the recessed base structure of the typical kitchen cabinet or the like enhances user comfort, it often makes cleaning the floor surface difficult. This problem is particularly acute for those areas or portions of the cabinet arrangement which form corners at the cabinet junctions. In the most common of kitchen arrangements, at least one and sometimes several right angle intersections of cabinet portions are provided to maximize space. The resulting corner junction of the cabinets and floor portion in the corner vicinity along the baseboards forms a difficult to reach and often hard to clean area.

A similar problem may arise in other cabinet structures such as those found in office work stations or other commercial environments which utilize floor supported storage cabinets or the like. In addition, in certain environments, other cabinet intersections with supporting surfaces such as countertops or worktops may provide similar difficult to clean corner portions.

In many commercial applications, as well as some kitchen environments, the problem is addressed by generally avoiding sharp angled corner cabinet intersections by using corner angled cabinet elements. For example, U.S. Pat. No. 5,028,098 issued to Fedder, et al. sets forth a MODULAR COUNTER WORK STATION FOR TELLERS in which a generally U-shaped work station is formed by a plurality of floor supported cabinet elements. A countertop having a similar U-shape is supported upon the cabinets. The corner portions of the cabinets and countertop include angled facets which define sufficient area to support the teller apparatus for the work station.

While some flexibility may be utilized to avoid sharp angled or right angled corner intersections in work environments such as kitchen cabinet structures or the like, there remains a continuing need in the art for providing an easier to clean structure for such areas without sacrificing the efficiency of such cabinet arrangements.

SUMMARY OF THE INVENTION

Accordingly, it is a general object to provide an improved cabinet structure for use in environments such as kitchen cabinets or office work stations. It is a more particular object of the present invention to provide a corner element which facilitates the cleaning activity associated with the corner junctions of kitchen cabinets, office work stations or the like.

In accordance with the present invention, there is provided for use in combination with a cabinet structure having convergingly angled base portions, a corner element comprises: a body having convergingly angled side portions corresponding to the angled base portions and a concave curved surface extending between the angled side portions forming intersecting edge portions therebetween, the body being positionable with the side portions contacting the base portions such that the curved surface extends between the base portions.

DESCRIPTION OF THE PREFERRED EMBODIMENT

Figure 1:
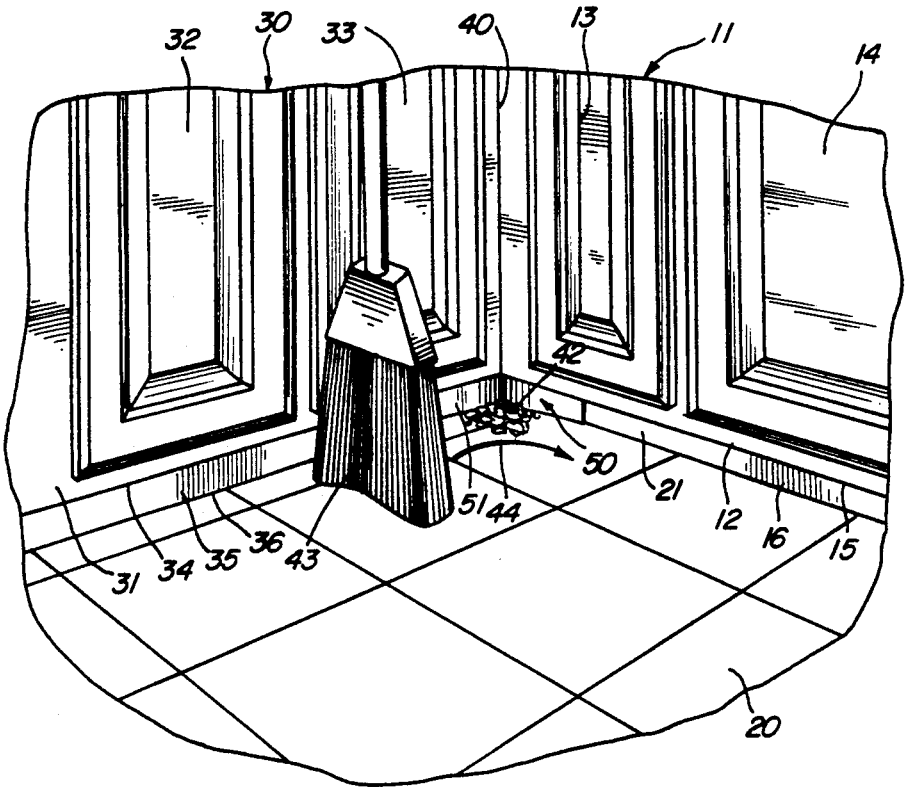
FIG. 1 sets forth a perspective view of a typical kitchen cabinet corner area having the present invention corner element utilized therein.

FIG. 1 sets forth a perspective view of a corner portion of a typical kitchen cabinet environment within which the present invention corner element has been utilized. A cabinet section 11 constructed in accordance with conventional fabrication techniques defines a front face 12 to which a plurality of access doors such as doors 13 and 14 have been secured. Front face 12 defines a lower edge 15 beneath which a recessed base portion 16 extends downwardly to support cabinet section 11 upon a floor 20. A similar cabinet section 30 also constructed in accordance with the conventional fabrication techniques defines a front face 31 which supports a plurality of access doors such as doors 32 and 33. Front face 31 defines a lower edge 34 beneath which a recessed base support 35 extends downwardly to support cabinet section 30 upon floor 20. Cabinet sections 11 and 30 intersect forming a corner portion 40. Similarly, recessed base portions 16 and 35 intersect to form a recessed base corner 41 (better seen in FIG. 3).

In accordance with the present invention, a corner element generally referenced by numeral 50 is received within the corner thus formed between recessed bases 16 and 35. Corner element 50 defines a concave generally cylindrical curved surface 51. In its preferred form, corner element 50 extends above floor 20 to a heighth generally corresponding to the heighth of recessed bases 16 and 35. A conventional broom 43 is shown utilized in FIG. 1 in a typical cleaning operation in which dirt and debris is being swept from the surface of floor 20. Also shown in FIG. 1, is an accumulated debris portion 42 within the corner intersection area of cabinet sections 11, 30 and floor 20. In accordance with an important aspect of the present invention, the utilization of corner element 50 and curved surface 51 thereof within the intersecting corner of recessed base portions 16 and 35 prevents accumulated debris 42 from extending into base corner 41 (seen in FIG. 3). Thus, in accordance with an important aspect of the present invention, the movement of broom 43 in a curved sweeping motion in the direction of arrow 44 causes accumulated debris 42 to be easily swept from the corner area of floor 20 and thus avoids the difficult cleaning problem otherwise posed by base corner portion 41. As can be seen by examination of FIG. 1, the provision of curved surface 51 greatly facilitates the ease with which the otherwise hard to reach corner portion of floor 20 is cleaned. As can also be observed in FIG. 1, the use of corner element 50 does not interfere with the above-mentioned advantages in kitchen cabinet utility and comfort provided by recessed base portions 16 and 35. It should also be noted that corner element 50 may be added to cabinet sections 11 and 30 at any convenient point in the structure assembly and may, if desired, be secured in a removable fashion to provide additional flexibility of use and adaptation.

Figure 2:
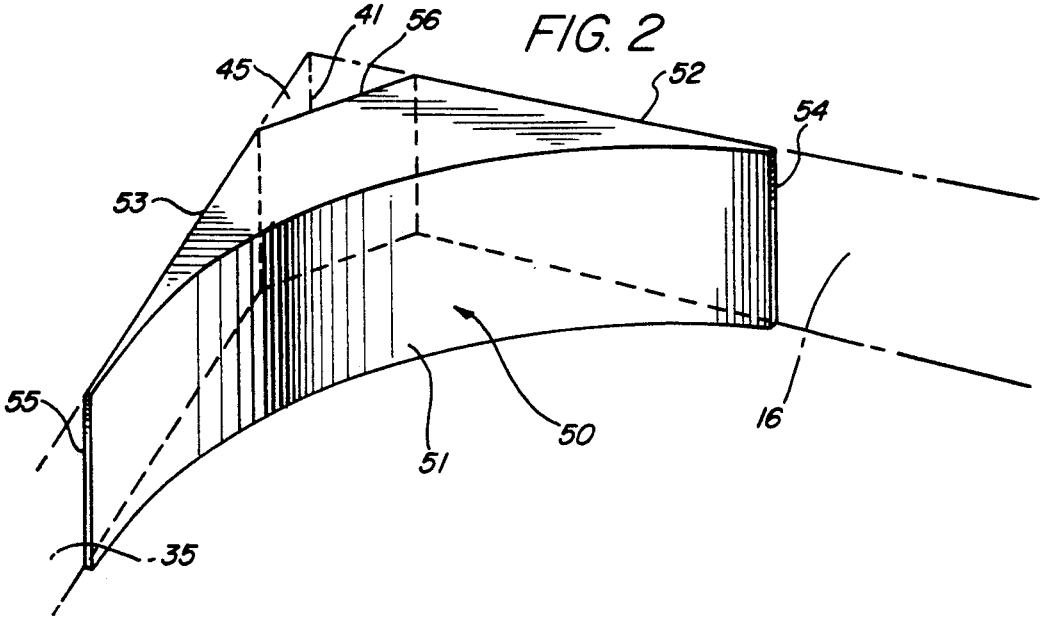
FIG. 2 sets forth a perspective view of the present invention corner element.

FIG. 2 sets forth a enlarged view of corner element 50 showing recessed base portions 16 and 35 in dashed line representation for purposes of reference. As described above, corner element 50 defines a concave preferably cylindrical curved surface 51. Corner element 50 further defines a pair of side surfaces 52 and 53 together with an angled facet 56. The angular relationship between side surfaces 52 and 53 is selected in correspondence with the angular relationship between recessed base portions 16 and 35 in the corner within which corner element 50 is to be utilized. Thus, in a common corner configuration, recessed base portions 16 and 35 intersect at approximately ninety degrees to form a right angle base corner 41. In such case, corner element 50 is correspondingly configured such that side portions 52 and 53 are mutually perpendicular. In accordance with an important aspect of the present invention, angled facet 56 extends between sides 52 and 53 of corner element 50 to provide substantial clearance between corner element 50 and corner 41 of recessed bases 16 and 35. This increased clearance substantially enhances the ease with which corner element 50 may be placed and permits the accommodation of less than perfect corner structures at corner portion 41.

In accordance with the present invention, curved surface 51 extends upwardly from floor 20 forming a curved intersection 57 which, as described above, greatly facilitates cleaning operations such as the above-described sweeping process. To further enhance the cleaning ease provided by corner element 50, sides 52 and 53 intersect curved surface 51 at the outer portions of corner element 50 to form substantially small thin edge portions 54 and 55 respectively. In its preferred form, corner element 50 is fabricated such that edges 54 and 55 are as small as practical to avoid the accumulation of debris at the intersections of edges 54 and 55 with bases 16 and 35 respectively and floor surface 20.

It will be apparent to those skilled in the art that corner element 50 may be fabricated utilizing a variety of materials such as wood or composite wood and resin material. It will be further apparent that corner element 50 may be fabricated of a molded plastic material or the like. It will also be apparent to those skilled in the art that the attachment of corner element 50 to recessed bases 16 and 35 may be easily accomplished using conventional adhesive deposits upon side portions 52 and 53 to permanently secure corner element 50. It is also recognized that in certain applications it may be desirable to secure corner element 50 in a removable attachment such as that provided by conventional fasteners or the like where such removable attachment is preferred. In certain environments, corner element 50 may also be utilized in the manner shown in FIG. 2 with the additional capability to support a conventional molded plastic base overlay such as that commonly used in office environments. In such case, the molded plastic base overlay may be adhesively secured directly to curved surface 51 and extend continuously from recessed base 16 across curved surface 51 to recessed base portion 35. In most installations, however, corner element 50 remains exposed as shown in FIG. 2 in which case curved surface 51 is preferably covered with a coordinated finish generally matching that of recessed base portions 16 and 35.

Figure 3:
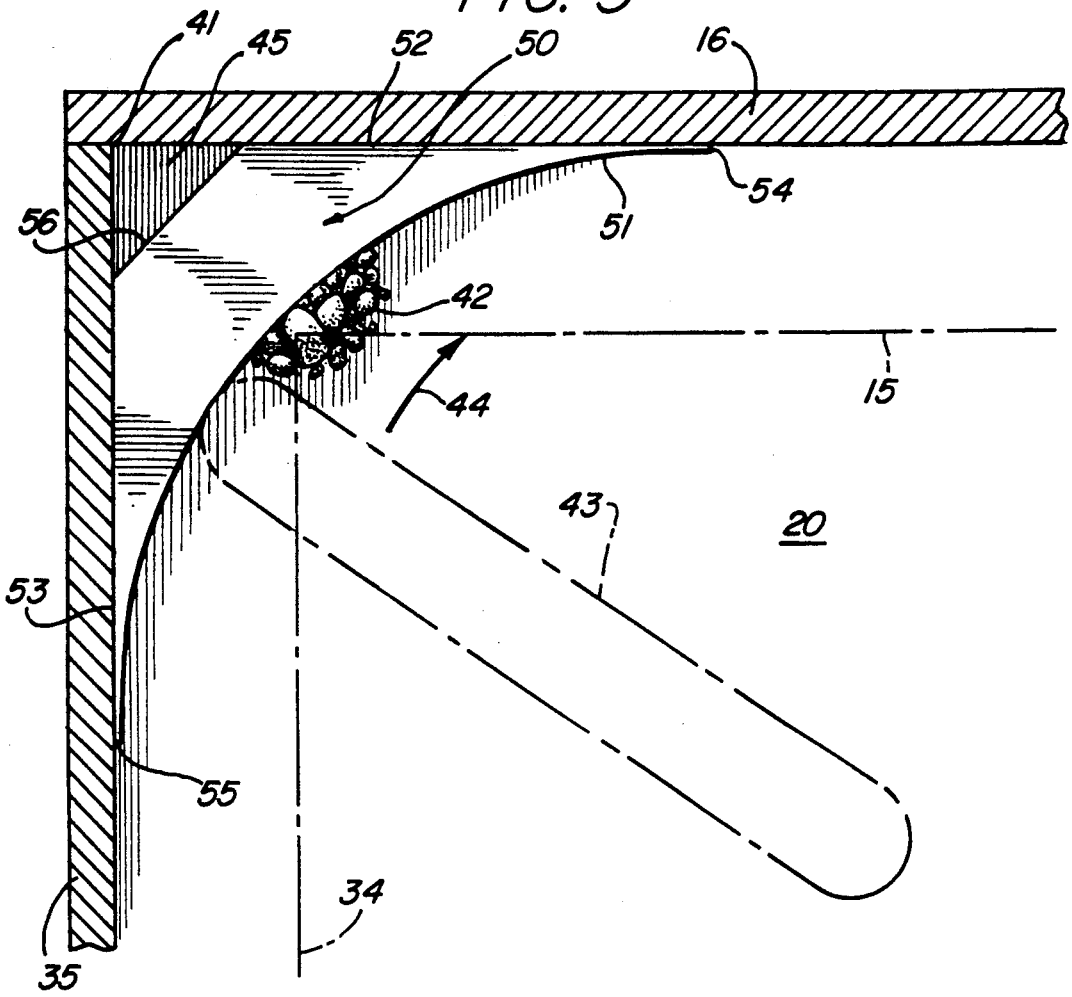
FIG. 3 sets forth a top plan view of the present invention corner element in a typical corner installation.

FIG. 3 sets forth a top section view of the corner installation of corner element 50 in the manner shown in FIG. 1. Thus, as described above, recessed base portions 16 and 35 of cabinet sections 11 and 30 respectively intersect to form a base corner 41. As is also described above, corner element 50 constructed in accordance with the present invention defines a curved generally cylindrical surface 51 and a pair of side surfaces 52 and 53. Angled facet 56 extends between the rear portions of side surfaces 52 and 53 and provides a clearance space 45 between base corner 41 and corner element 50. Curved surface 51 intersects side surfaces 52 and 53 at a pair of narrow preferably thin edge portions 54 and 55 respectively. For purposes of illustration, edge portions 15 and 34 of cabinet sections 11 and 30 respectively are shown in dashed line representation to illustrate the recessed position of base portions 16 and 35.

As described above, during the cleaning process, an accumulated debris quantity 42 is often found or encountered at the corner portion formed by floor 20 and recessed base portions 16 and 35. In accordance with the present invention, corner element 50 and curved surface 51 thereof cooperate to prevent this accumulated debris from accumulating at base corner 41. Thus, with debris 42 maintained by curved surface 51 at the portion of floor 20 shown, the movement of broom 43 in a typical sweeping motion such as that shown by arrow 44 easily permits broom 43 to wisk the accumulated debris from the corner area of floor 20. But for corner element 50, this debris accumulation would occur in the remote angled portion of base corner 41 making cleaning difficult and time consuming.

As mentioned above, FIG. 1 as well as FIG. 3 depicts the most typical intersection corner found in kitchen cabinets or the like in which base portions 16 and 35 form a right angle intersection. As is also mentioned above, the angular relationship between sides 52 and 53 is correspondingly configured to provide a similar right angled relationship. This facilitates the installation and attachment of corner element 50. It will be apparent to those skilled in the art, however, that the angular relationship between sides 52 and 53 is correspondingly configured to match the angular relationship between base portions 16 and 35 in the event the intersections thereof form a different angle. Thus, in the event base portion 16 and 35 intersect at an acute angle, for example, corner element 50 is preferably fabricated such that sides 52 and 53 define a corresponding acute angle. A similar situation, of course, arises in the event an oblique angle intersection is defined by base portions 16 and 35.

Figure 4:
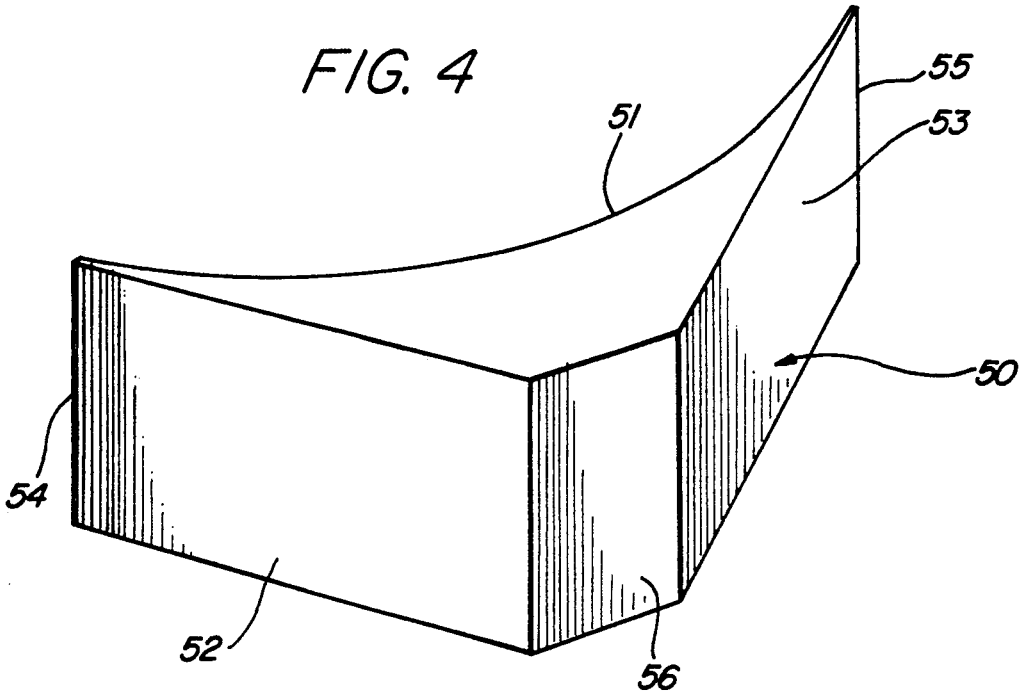
FIG. 4 sets forth a rear perspective view of the present invention corner element.

FIG. 4 sets forth a rear perspective view of corner element 50. Thus, as described above, corner element 50 defines a concave preferably cylindrical curved surface 51 and a pair of generally planar side portions 52 and 53. An angled facet 56 extends between side portions 52 and 53. The intersection of curved surface 51 with side portions 52 and 53 forms edge portions 54 and 55 respectively.

What has been shown is a convenient, easy to install, low cost corner element which may be utilized in virtually any configuration of cabinet corner environments to greatly facilitate the cleaning process of the floor portions in such corner floor areas. The corner element shown may be fabricated using a variety of materials such as wood, composite wood and resin material, or molded plastic. The corner element shown may be inexpensively fabricated and may be fabricated to suit a variety of cabinet intersection angles.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed:

1. For use in combination with a cabinet structure having convergingly angled base portions, a corner element comprising:

a body having convergingly angled side portions corresponding to said angled base portions and a generally vertical concave generally cylindrically curved surface extending between said angled side portions forming generally vertical intersecting thin edge portions therebetween, said body being positionable with said side portions contacting said base portions such that said curved surface extends between said base portions.

2. A corner element as set forth in claim 1 wherein said body further includes an angled facet extending between said angled side surfaces spaced from said curved surface.

3. A corner element as set forth in claim 2 wherein said body includes generally parallel top and bottom surfaces forming right angle intersections with said side surfaces.

4. A corner element as set forth in claim 3 wherein said body is generally solid.

5. A corner element as set forth in claim 3 wherein said side portions are generally planar.

6. A corner element as set forth in claim 3 wherein said concave curved surface is generally cylindrical and defines a substantially constant radius of curvature.

7. A corner element as set forth in claim 5 wherein said side portions are generally perpendicular.

8. For use in filling a cabinet base interior corner, a corner element comprising:

a body having generally planar generally parallel top and bottom surfaces, a pair of generally planar side surfaces each generally perpendicular to said top and bottom surfaces and forming a converging angle therebetween and diverging and converging portions, and a vertical concave generally cylindrically curved surface extending between said diverging portions of said side portions and;

said curved surface meeting said side surfaces to form thin vertical edge portions.

9. A corner element as set forth in claim 8 wherein said body defines an oblique facet extending between said side portions at said converging portions thereof.

* * * * *